United States Patent [19]

Saigh et al.

[11] 4,012,322

[45] Mar. 15, 1977

[54] MACERATOR-STERILIZER SEWAGE TREATMENT SYSTEM

[75] Inventors: Philip A. Saigh, Morton Grove; Albert J. Glueckert, Skokie, both of Ill.

[73] Assignee: General American Transportation Corporation, Chicago, Ill.

[22] Filed: May 5, 1975

[21] Appl. No.: 574,535

[52] U.S. Cl. ..... 210/86; 4/8; 4/10; 4/11; 4/131; 210/71; 210/120; 210/134; 210/138; 210/149; 210/152

[51] Int. Cl.[2] ..... E03D 1/00

[58] Field of Search ..... 4/8, 10, 11, 76, 79, 4/84, 87, 118, 131; 137/211, 587; 210/64, 71, 86, 88, 89, 97, 104, 120, 134, 138, 142, 149, 152, 180

[56] References Cited

UNITED STATES PATENTS

| | | | |
|---|---|---|---|
| 2,658,202 | 11/1953 | Wolman et al. | 4/8 |
| 2,748,799 | 6/1956 | Rath | 137/587 |
| 2,899,900 | 8/1959 | Haskett | 137/211 X |
| 2,988,002 | 6/1961 | Dodd | 137/211 |
| 3,212,639 | 10/1965 | Anderson | 210/86 X |
| 3,546,713 | 12/1970 | Gagne | 210/149 X |
| 3,733,617 | 5/1973 | Bennet | 210/152 X |
| 3,746,167 | 7/1973 | Arthur | 210/86 X |
| 3,787,901 | 1/1974 | Wagner et al. | 4/10 |

*Primary Examiner*—Charles N. Hart
*Assistant Examiner*—R. G. Mukai
*Attorney, Agent, or Firm*—Claron N. White

[57] ABSTRACT

The macerator-sterilizer sewage treatment system, that is useful in an overall toilet system to collect, treat and discharge toilet wastes, comprises: macerator/transfer pump means to receive flushed human waste from toilets and urinals; a collection tank connected by conduit means to the outlet of the pump means; a sterilization tank connected by power-operated valved transfer means and transfer pump means to the collection tank; heater means in the sterilization tank; power-operated valved discharge means connected to an outlet of the sterilization tank; and electrical means to control the operation of the macerator/transfer pump means, of the transfer pump means between the collection tank and the sterilization tank, of the heater means, of the power-operated valved discharge means connected to the outlet of the sterilization tank and of the power-operated valved transfer means. The electrical control means initiates in response to a flushing operation the operation of the macerator/transfer pump means for a predetermined period of time, initiates in response to a predetermined accumulation of the flushed human waste in the collection tank the operation of the transfer pump means for a predetermined time and opens the valve of the valved transfer means for a predetermined time to transfer waste from the collection tank to the sterilization tank, controls the operation of the heater means, and then after a preset time opens the valve of the valved discharge means for a predetermined time. The electrical control means also prevents the operation of the macerator/transfer pump means during an initial portion of the transfer of waste from the collection tank to the sterilization tank even though flushed waste is provided to the macerator/transfer pump means and prevents the operation of the transfer pump means and the opening of the valve of the valved transfer means that transfer flushed waste from the collection tank to the sterilization tank until the waste is sterilized in and discharged from the sterilization tank.

24 Claims, 3 Drawing Figures

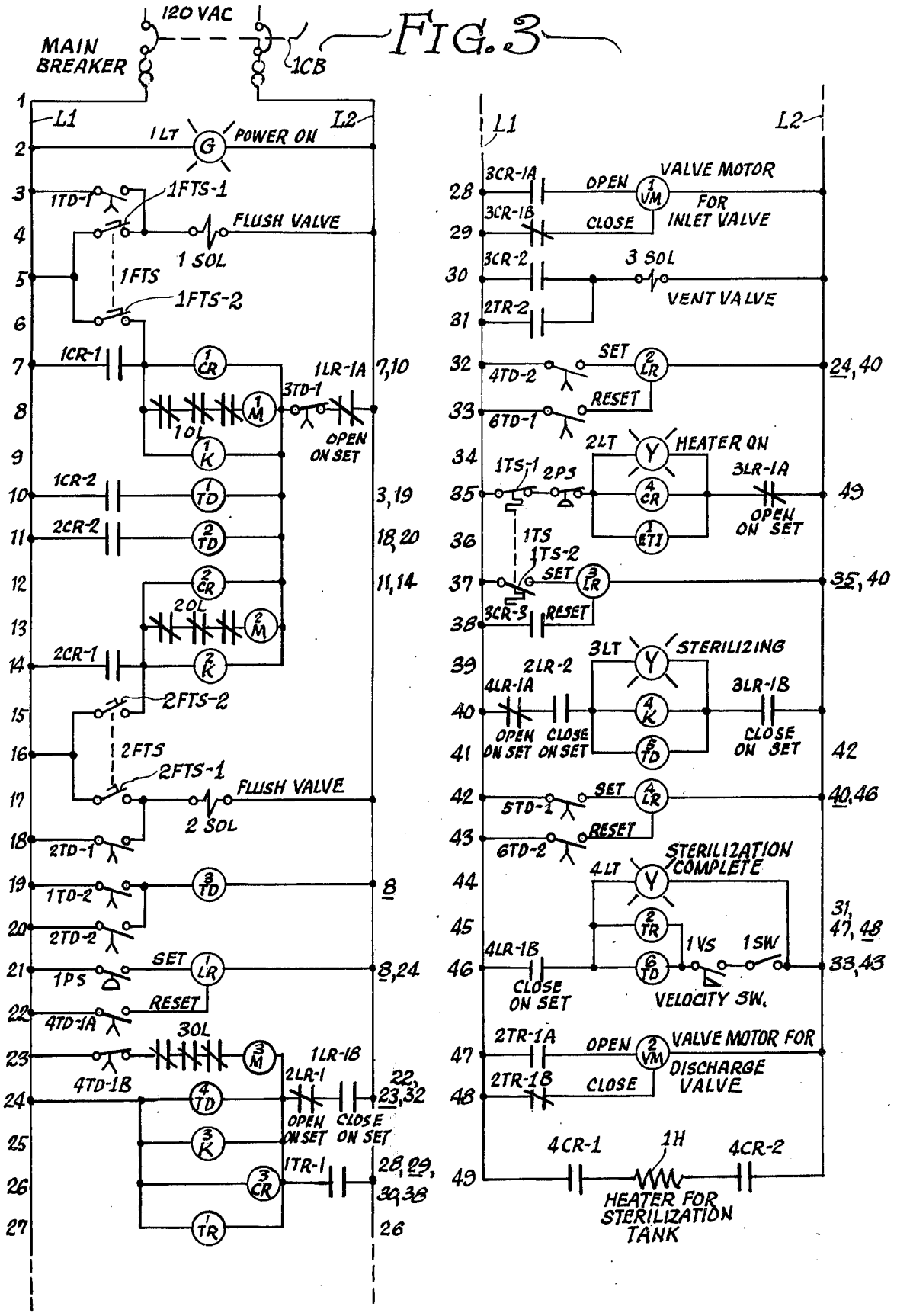
FIG. 3
120 VAC
MAIN BREAKER
1CB
L1
L2
1LT
POWER ON
1TD-1
1FTS-1
FLUSH VALVE
1 SOL
1FTS
1FTS-2
1CR-1
1CR
1LR-1A
7,10
3TD-1
1M
1OL
OPEN ON SET
1K
1CR-2
1TD
3,19
2CR-2
2TD
18,20
2CR
11,14
2OL
2M
2CR-1
2K
2FTS-2
2FTS
2FTS-1
FLUSH VALVE
2 SOL
2TD-1
3TD
8
1TD-2
2TD-2
SET
1LR
8,24
1PS
RESET
4TD-1A
3OL
3M
1LR-1B
4TD-1B
2LR-1
22, 23,32
4TD
OPEN ON SET
CLOSE ON SET
3K
1TR-1
28,29, 30,38
3CR
1TR
26
3CR-1A
OPEN
VALVE MOTOR
1VM
FOR INLET VALVE
3CR-1B
CLOSE
3CR-2
3 SOL
VENT VALVE
2TR-2
SET
2LR
24,40
4TD-2
RESET
6TD-1
2LT
HEATER ON
1TS-1
2PS
4CR
3LR-1A
49
OPEN ON SET
1ETI
1TS
1TS-2
SET
3LR
35,40
3CR-3
RESET
3LT
STERILIZING
2LR-2
4LR-1A
4K
3LR-1B
OPEN ON SET
CLOSE ON SET
5TD
CLOSE ON SET
42
SET
4LR
40,46
5TD-1
RESET
6TD-2
STERILIZATION COMPLETE
4LT
2TR
31, 47, 48
1VS
1SW
4LR-1B
6TD
33,43
CLOSE ON SET
VELOCITY SW.
2TR-1A
OPEN
VALVE MOTOR FOR
2VM
DISCHARGE VALVE
2TR-1B
CLOSE
4CR-1
1H
4CR-2
HEATER FOR STERILIZATION TANK

MACERATOR-STERILIZER SEWAGE TREATMENT SYSTEM

BACKGROUND OF THE INVENTION

1. Field of the Invention

This invention relates to toilet systems that treat flushed human wastes from a toilet or a urinal and more especially relates to systems that macerate the flushed human waste followed by a sterilization before discharge from the system.

2. Description of the Prior Art

Broadly speaking there are two general types, recirculating and nonrecirculating, of toilet systems that receive human body waste.

The recirculating toilet systems are particularly useful on airplanes. For these systems it is necessary to provide initially in a waste-receiving tank a limited amount of flush water. The flushed water flows into that tank. During each subsequent use filtered water is pumped to the toilet as flush water from the accumulated mixture of initial water and increasing content of human body waste. These recirculating toilet systems minimize the amount of flush water required to be added to the airplane at the start of a period of service of the toilet system in the airplane. Some systems of this type provide a periodic withdrawal from the tank of a part of the accumulated mixture of body waste and initial flushing water to another tank in which it is heated to evaporate part of the water content. The latter systems of this type are disclosed in assignee's U.S. Pat. Nos. 3,535,712 and 3,536,196. In these patents it is disclosed that this evaporation of part of the water content produces a slurry that can be incinerated. The incineration of the slurry to ash after the evaporation can be performed in the same tank when the heated tank etc. are suitably constructed.

In another recirculating toilet system, that is shown in U.S. Pat. No. 3,831,534, the accumulated mixture of initial flush water and human body waste is periodically transferred to an incinerator in which the liquid content is evaporated and discharged and the solids are converted to ash by a combustion flame.

A modified recirculating toilet system is disclosed in U.S. Pat. No. 3,733,617. In that system the human waste is macerated during transfer to a tank from which it is fed to a heated vacuum chamber in which volatile liquid of the waste is evaporated while the solids are withdrawn from the bottom as dehydrated waste. The evaporated liquid is condensed and that liquid is transferred to a vessel from which it is pumped to the toilet for the flushing of the toilet.

The nonrecirculating toilet systems are used in facilities including mobile vehicles, such as passenger railroad cars and marine units, that have available a source of flush water that is not limited as is the case for the recirculating toilet systems installed in airplanes. These toilet systems when installed, for example, in passenger railroad cars and marine units, do not have the capability of transferring the flushed human waste to a sanitary sewer system as is the case for those nonrecirculating toilet systems installed in homes. In the past the toilet systems in passenger railroad cars merely dumped the flushed waste along the railroad right-of-way during the travel of the train. In the case of marine units the human waste from toilet systems was dumped overboard without any treatment.

Various systems have been developed to treat the human waste before dumping it. One system, that is illustrated by U.S. Pat. No. 3,846,847, includes means to add a tablet to the flushed waste prior to its maceration. The macerated waste is transferred to a decontamination tank. The tablet provides a chemical decomposition of the waste. The product is dumped. In the marine toilet system of U.S. Pat. No. 3,699,592 flushed human waste is macerated and chemically treated before dumping overboard.

The addition of a chemical tablet or fluid to the flushed waste requires equipment to dispense the chemical during the transfer operation and it is necessary to ensure that the supply has not been depleted. Chlorination has been used to destroy bacteria prior to discharging the macerated flushed waste from the toilet system. The chlorination is not totally effective for the treatment of human waste containing solids and it does not necessarily kill the spores and viruses. Of course, it is desirable to avoid handling of chlorine tanks for their connection into a toilet system for treating human waste.

Instead of a chemical treatment of the entire flushed waste the toilet system described in U.S. Pat. No. 3,548,421 provides a separation of the flushed waste to provide a solid waste matter that is incinerated and a liquid that is subjected to a chemical treatment. In toilet system of U.S. Pat. No. 2,768,386 the flushed waste is homogenized and then transferred to an incinerator in which the liquid content is volatized and discharged to the atmosphere and the solids are incinerated in the same operation.

Assignee's U.S. Pat. No. 3,787,901 claims a toilet system in which the flushed human waste is macerated and then transferred to a storage tank in which the macerated waste is heated to evaporate water for a volume reduction of the waste. In the event that it is desired to treat the resultant concentrated flushed waste at the site of the toilet system, the toilet system further includes an incinerator to which the concentrated flushed waste is transferred for its conversion to gas and solids.

The most pertinent toilet systems of the nonrecirculating type are those described in U.S. Pat. Nos. 3,395,799, 3,396,410 and 3,546,713.

In the marine toilet system of U.S. Pat. No. 3,395,799 the flushed waste is passed through a triturator in which the solid particles of the waste are finely ground and then the flushed waste is transferred to a tank in which it is heat-treated at a predetermined temperature for a predetermined time before being discharged. The patent teaches that the heat treating is continued at a temperature of at least 140° F. for a period of at least 30 minutes.

In the toilet system of U.S. Pat. No. 3,396,410 the flushed waste is discharged from the toilet to a tank. When sufficient flushed water is accumulated in the tank, the waste will be recirculated through a heating zone until the waste in the zone reaches a temperature that causes a valve to open. It is stated that this temperature is sufficient to destroy or neutralize harmful bacteria. Then the liquid waste is transferred from the tank through the valve until the level of flushed waste in the tank falls to the level at which recirculation and heating cease. When sufficient additional flushed waste has been added to the tank, heating and recirculation resume.

In the toilet system of U.S. Pat. No. 3,546,713 flushed waste from a toilet is macerated and pumped to a storage tank where it is accumulated until the height of the flushed waste rises to a level at which it actuates a level sensor mounted in the lower portion of the storage tank. At this level the flushed waste in the storage tank has a volume at least equal to the capacity of a smaller treatment tank. The energization of the level sensor initiates the operation of a pump between the two tanks. Before the level in the storage tank is lowered to a level in which the level sensor is no longer energized a sensor in the bottom of the treatment tank is operated by the initial portion of waste transferred to the treatment tank from the storage tank so that the pump continues to operate. Adjacent the top of the treatment tank there is another level sensor that is operated by the transferred flushed waste in the treatment tank when it rises to that level. That sensor, when operated, stops the operation of the pump transferring flushed waste from the storage tank to the treatment tank. The treatment tank is adapted to contain a much smaller quantity of waste than the storage tank can contain. The treatment tank is provided with a heater that is turned on when the pump operation is initiated. A temperature responsive sensor is positioned in the treatment tank and it operates when the temperature of the flushed waste in the tank reaches a relatively high predetermined temperature, for example, 300° or 350°. when the temperature sensor is energized upon attainment of the predetermined temperature, it turns off the heater and initiates the operation of a pump for removal of treated flushed waste from the treatment tank. That pump continues to operate until the sensor at the bottom of the treatment tank is no longer energized by flushed waste in the treatment tank.

In the system of U.S. Pat. No. 3,546,713, a cycle, of transfer of waste from the storage tank to the treatment tank, of heat treatment in the latter tank and then discharge from it, is repeated so long as the level of flushed waste in the storage tank is above the minimum level as determined by the level sensor in the storage tank. The treatment tank is connected at its top to a safety valve that connects with a vent line extending from the top of the storage tank to a discharge opening in the wall of the side of the boat in which the marine toilet system is installed. This safety valve is normally closed and is opened only when the anticipated maximum operating pressure in the treatment tank is exceeded. A check valve is in a line between the treatment tank and the pump that transfers flushed waste from the storage tank.

The toilet system disclosed in U.S. Pat. No. 3,734,852 heat treats flushed waste. The waste is elevated to a temperature of at least the boiling point of water. Control means is provided for retaining the waste in a heat-treatment means for a sufficient period of time at an elevated temperature whereby the bacterial count of the waste is reduced to a tolerable level. In the system the flushed waste is transferred from a holding tank to the heat-treatment means that includes a heated chamber through which the waste is moved by a rotating screw while being heated to the temperature of at least that of boiling water. The speed of the screws is controlled so that the retention time of the waste is subjected to sufficient heat to substantially destroy all of the bacteria so that the baterial count is no more than the low tolerable level. The construction may also include a valve that prevents the waste from being discharged from the heat-treatment means by the screw until the temperature of the waste is at least at the boiling point of water.

The patents mentioned above are illustrative of the prior art of toilet systems. There may be other more pertinent art.

SUMMARY OF THE INVENTION

The macerator-sterilizer sewage treatment system of the present invention is especially useful as a part of an overall toilet system to collect, treat and discharge toilet waste. The macerator-sterilizer sewage treatment system may be used to treat other sewage that requires a treatment to convert it to a form that can be discharged onto land or water. For simplicity the system is described and illustrated below as a part of a toilet system.

The macerator-sterilizer sewage treatment system comprises: macerator/transfer pump means to receive flushed human waste from toilets and urinals; a collection tank having an inlet connected by conduit means to the outlet of the macerator/transfer pump means; transfer pump means connected to an outlet of the collection tank; a sterilization tank; power-operated valved transfer means connected to an inlet of the sterilization tank and to the pump means connected to the outlet of the collection tank; heater means in the sterilization tank; power-operated valved discharge means connected to an outlet of the sterilization tank; and electrical control means.

The macerator/transfer pump means includes a motor. The transfer pump means, between the collection tank and the power-operated conduit means connected to the sterilization tank, includes a pump having an inlet connected to the collection tank and an outlet connected to that power-operated valved transfer means and further includes a motor to operate that pump. The power-operated valved transfer means connected to that transfer pump means and to the sterilization tank includes a valve and a motor to open and close that valve. The power-operated valved discharge means includes a valve and a motor to open and close that valve.

The electrical control means initiates, in response to a flushing operation, the operation of the macerator/-transfer pump means for a predetermined period of time, initiates in response to a predetermined accumulation of the flushed human waste in the collection tank the operation of the transfer pump means, for a predetermined time, and opens the valve of the power-operated valved transfer means, for a predetermined time, to transfer flushed waste from the collection tank to the sterilization tank, controls the operation of the heater means and after a predetermined delay opens and later closes the valve of the power-operated valved discharge means. The electrical control means does not initiate, in response to a flushing operation, the operation of the macerator/transfer pump means during an initial portion of the transfer of waste from the collection tank to the sterilization tank. The control means also prevents the operation of the transfer pump means to transfer flushed waste from the collection tank to the sterilization tank from the start of the operation of the heater means until the discharge of waste from the sterilization tank is completed and the discharge valve is closed.

To provide the functions mentioned above the electrical control means includes sensing means operative in response to a condition provided by an accumulation of flushed waste received in the collection tank. The sensing means comprises switch means including a switch mounted in the collection tank. It is especially preferred that the switch be a normally open pressure switch mounted in the top portion of the collection tank. The electrical control means also includes means responsive to the operation of the sensing means to operate the motor of the transfer pump means and the motor of the power-operated valved transfer means for an opening of its valve and to operate a time-delay relay means that after a predetermined period of time ceases the operation of the motor of the transfer pump means and later operates the motor of the power-operated valved transfer means for a closing of its valve.

The means responsive to the operation of the sensing means also initiates the operation of the heater means. The electrical control means has a temperature-sensing switch means mounted on the sterilization tank. This temperature-sensing switch means is operative in response to a predetermined temperature of the flushed waste, heated in the sterilization tank by the heater means, to cease the operation of the heater means. A time-delay relay means of the electrical control means is initiated in response to the operation of the temperature-sensing means when the flushed waste reaches the predetermined temperature. The time-delay means, when operated, initiates after a predetermined delay the operation of the motor of the valved discharge means to open the valve of that valved discharge means and to initiate after a further predetermined period of time the operation of that motor to close that valve.

The system of the invention further includes a power-operated valved vent means having a power-generated valve communicating with the top portion of the sterilization tank. This power-operated valve is preferably a solenoid valve. The power-operated valved vent means is responsive to the sensing means to open its valve, during the time that the motor of the pump transfer means is operative and the valve of the valved transfer means is open to vent gas from the sterilization tank during the transfer of flushed waste from the collection tank to the sterilization tank. The power-operated valved vent means is also responsive to the initiation of operation of the time-delay relay that initiates the operation of the motor of the power-operated valved discharge means for the opening of its valve.

In the use of the macerator-sterilizer sewage treatment system of the invention as a part of an overall toilet system the system includes a macerator/transfer pump means that has its outlet connected to the collection tank. The inlet of the macerator/transfer pump means is connected to outlets of one or more of commodes, i.e., toilets, and urinals. In this use of the system of the invention the flushing of a toilet or a urinal initiates a part of the electrical control means that operates the motor of the macerator/transfer pump means for a predetermined period of time to transfer macerated flushed waste to the collection tank.

Before the end of that predetermined time of operation the electrical control means initiates, in a preferred aspect of the system, a second flushing operation of the toilet or urinal. The output of the toilet has a dump valve that, when opened, closes a switch to initiate the first flushing operation by energizing a solenoid in the line providing flush water to the toilet. That solenoid is a part of the electrical control means and another part of the electrical control means energizes the solenoid again for the second flushing operation but cannot be so until the solenoid is deenergized. In the normal operation the dump valve is closed shortly after the first flushing operation is initiated. This opens the switch to deenergize the solenoid so that after the predetermined period of time it can be energized for the second flushing operation. During this second flushing operation the dump valve is closed so that flush water accumulates in the bottom of the toilet bowl where it remains until the next use and flushing of the toilet.

This double flushing operation and this operation of the macerator/transfer pump means is repeated after each use of the toilet or urinal until the macerated flushed waste is accumulated in the collection tank to the extent that the switch of the sensing means is operated.

The electrical control means includes means, when the switch of the sensing means is operated, to prevent the operation of the macerator/transfer pump means until the transfer of flushed waste from the storage tank to the sterilization tank is completed.

DESCRIPTION OF THE DRAWINGS

FIG. 3 is an electrical schematic drawing of the electrical control means of the overall toilet system illustrated by two toilets connected to the same macerator/-transfer pump.

Referring to FIG. 1 it is seen that human waste is added to toilets and/or urinals and this is flushed away by flush water to provide a flushed waste that is identified as sewage. The outlets of the toilets and urinals are connected to the inlets of the macerator/transfer pumps that receive this flushed waste. This connection between a toilet and a macerator/transfer pump is illustrated in FIG. 2 in which a toilet 11 has its outlet connected to a macerator/transfer pump 12. The toilet is connected to a water supply that provides flush water through a flush valve 13 to toilet 11. The toilet in this illustrative embodiment has a foot pedal 14 that, when depressed, opens a dump valve (not shown) in the outlet of toilet 11 and closes a switch 1FTS (FIG. 3) having two normally open contacts. One of these contacts is in series with a solenoid 1SOL of flush valve 13 that when energized, by closing of that normally open contact of switch 1FTS, initiates the operation of valve 13 to open it for a predetermined period of time. When the pedal is no longer depressed, switch 1FTS opens and thereby solenoid 1SOL is deenergized.

Figure 1:
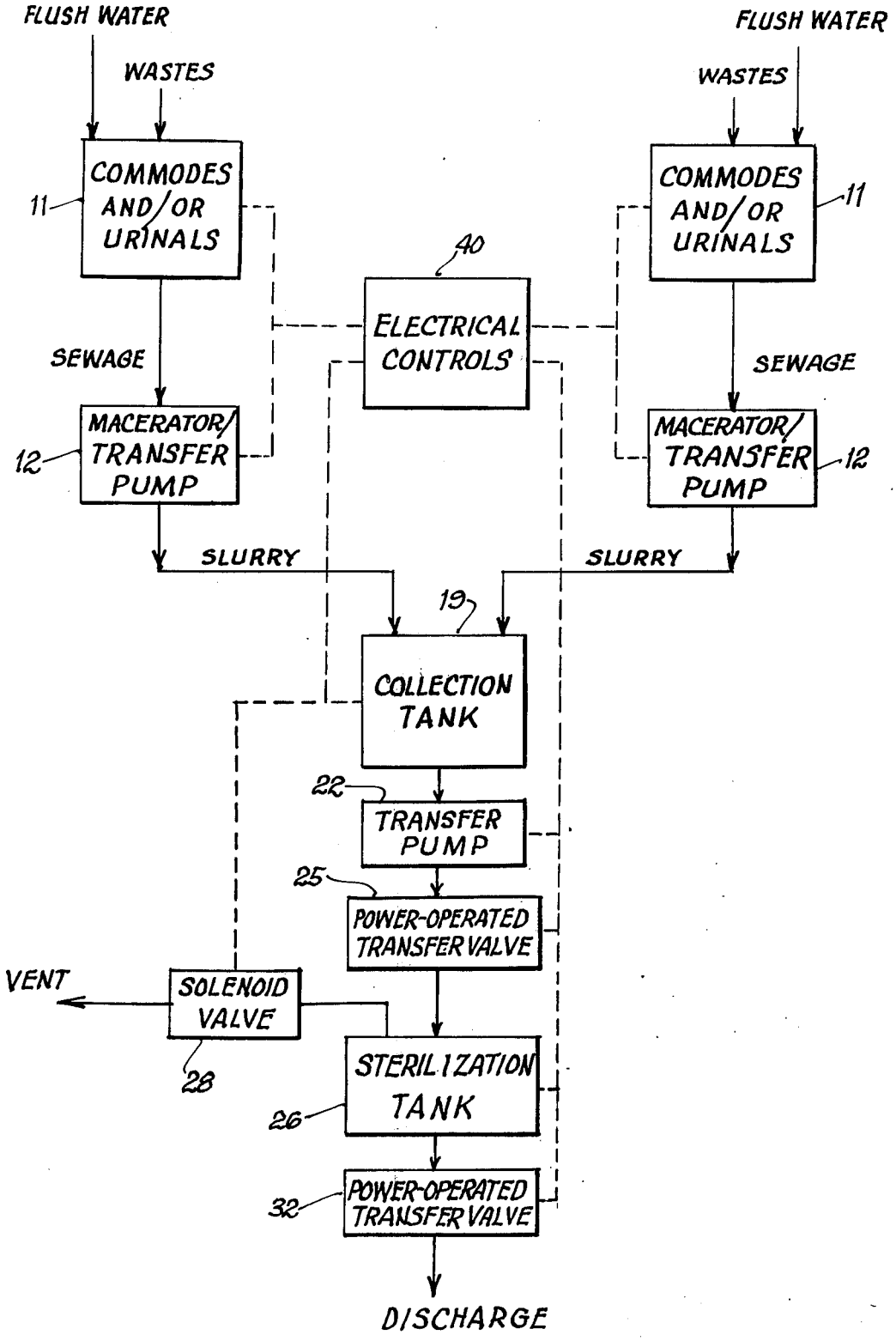
FIG. 1 is a block diagram of the system of the invention in its use in an overall toilet system.
Figure 2:
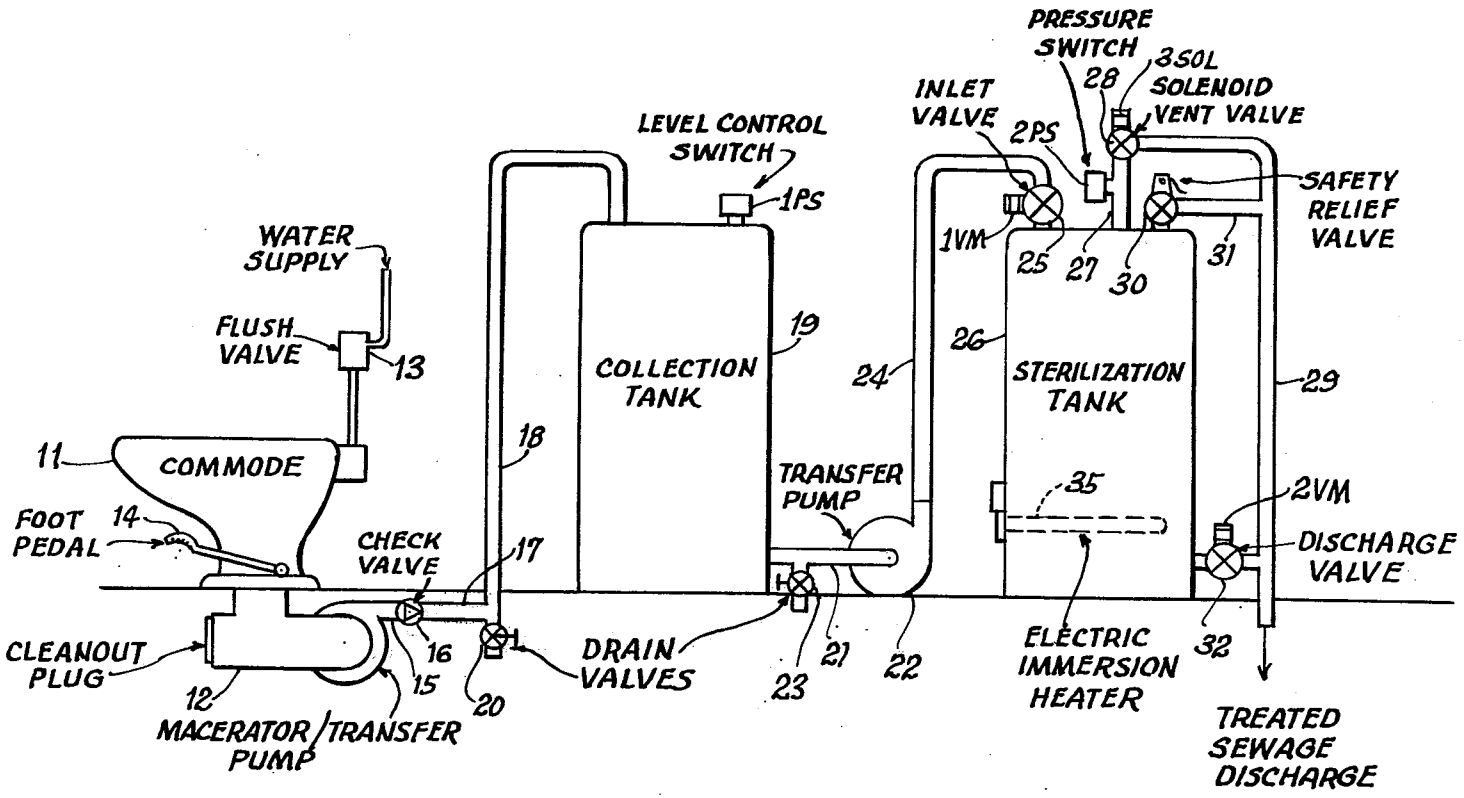
FIG. 2 is a schematic drawing of the system of the overall toilet system illustrated by one toilet connected to a macerator/transfer pump.

In a preferred construction valve 13 has a conventional construction in which it remains open after 1SOL is energized for a predetermined period of time and then closes even if foot pedal 14 is still depressed. This type of flush valve 13 provides a limited amount of flush water to the system each time solenoid 1SOL is energized. As described later, the electrical control system provides for a later energization of solenoid 1SOL for a second flush.

The outlet of macerator/transfer pump 12 is connected by a pipe 15, a check valve 16, and a pipe 17 to a pipe 18 that is connected to an inlet of a collection tank 19. The pipe 18 extends beyond its connection with pipe 17 to a drain valve 20. A level control switch 1PS is mounted on the top of tank 19. The switch 1PS is a pressure switch that senses the pressure at the top portion of tank 19.

A bottom outlet of tank 19 is connected by a pipe 21 to a transfer pump 22. The pipe 21 is connected by a pipe (not numbered) to a drain valve 23. The outlet of transfer pump 22 is connected by a pipe 24 to a power-operated inlet valve 25 having a motor 1VM that when energized opens valve 25 and when next energized closes valve 25. The outlet of valve 25 is connected to a sterilization tank 26.

A vent pipe 27 is connected to an opening in the top of tank 26. The pipe 27 has a side arm (not numbered) on which is mounted a pressure switch 2PS to sense the pressure in tank 26. The top end of pipe 27 is connected to a solenoid vent valve 28 having a solenoid 3SOL that, when energized, opens valve 28. When solenoid 3SOL is deenergized, valve 28 closes. The output of valve 28 is connected to a pipe 29. The top of tank 26 is connected to a safety relief valve 30 that opens if a predetermined pressure in tank 26 is exceeded. The outlet of valve 30 is connected by a pipe 31 to pipe 29. A power-operated valved discharge means includes a valve 32 and a motor 2VM. The inlet of valve 32 is connected to the bottom portion of tank 26 while the outlet of valve 32 is connected to a pipe 29 to provide a connection between the bottom portion of tank 26 and pipe 29 that serves primarily as a discharge pipe for sterilized waste from tank 26.

An electric immersion heater 35 is mounted in tank 26. The heater 35 includes a resistance 1H (FIG. 3). As seen in FIG. 1, the system includes electrical controls 40. The electrical controls 40 is connected to the other components shown in FIG. 1. These connections are shown schematically by dotted lines. The actual connections are shown in detail in FIG. 3.

In FIG. 3 there is shown the electrical control system of the system of the invention that is illustrated in its use with two identical toilets 11, their foot pedals 14, and flush valves 13. One of toilets 11 has a switch designated 1FTS that is operated by the depressing of pedal 14 of that toilet while the other toilet has a switch 2FTS operated by pedal 14 of the second toilet.

The electrical control system includes lines L1 and L2 that are connected to a 120 volt alternating current (120 VAC). The lines include a circuit breaker 1CB that provides a main disconnect for the control system. To the left of line L1 there are numerals. The numeral 1 merely indicates the connection of lines L1 and L2 to circuit breaker 1CB. The other numerals designate circuits, subcircuits or a common line connecting subcircuits to line L1 to complete the circuits. Some subcircuits are in parallel with on or more components of a circuit or a subcircuit and in series with one or more components of that circuit or of another subcircuit. To the right of line L2 appears numerals that designate circuits or subcircuits containing contacts affected by those circuits or subcircuits. Circuit 2 merely contains a light 1LT that is lit when the power is connected to the electrical control system.

The circuit 4 includes in series a solenoid 1SOL and a normally open contact 1FTS-1 of switch 1FTS. That contact is connected to line L1. The solenoid 1SOL is a part of flush valve 13 for the first toilet 11. The subcircuit 3 has a normally open contact 1TD-1 that is connected to line L1 and is in series with solenoid 1SOL and is in parallel with contact 1FTS-1 in circuit 4, so that solenoid 1SOL is energized when contact 1FST-1 in circuit 4 is closed to initiate a first flushing operation and is energized again when contact 1TD-1 is closed to initiate a second flushing operation.

A second normally open contact 1FTS-2 of switch 1FTS is in subcircuit 6. Both normally open contacts of switch FTS are connected at line 5. The subcircuit 7 includes a coil 1CR of a relay that has two normally open contacts 1CR-1 and 1CR-2. The coil 1CR is in series with contact 1CR-1 that are connected to line L1 and in series with contact 1FTS-2. A subcircuit 8 includes, in parallel with coil 1CR, thermal overload contacts 1OL for and in series with a coil 1M of a starter relay for the motor of macerator/transfer pump 12. This part of subcircuit 8 is connected to contact 1CR-1 of subcircuit 7. The subcircuit 8 further includes in series with overload thermal contacts 1OL and coil 1M a normally closed contact 3TD-1 and a normally closed contact 1LR-1A that is connected to line L2 to provide a complete circuit including 1CR-1 of subcircuit 7 and another complete circuit including contact 1FTS-2. The coil 1CR is connected to contact 3TD-1 and thereby through contact 1LR-1A to line L2 to provide a circuit including contact 1CR and a circuit including contact 1FTS-2 between lines L1 and L2. The subcircuit 9 has a counter 1K in parallel with coil 1CR of subcircuit 7 and is connected to contact 1FTS-2 and to contact 3TD-1 to complete another circuit. The counter 1K merely counts the number of uses of that toilet.

The subcircuit 10 includes in a series another normally open contact 1CR-2, of the relay having coil 1CR, and a coil 1TD, of a time-delay relay, that is connected to contact 3TD-1 while contact 1CR-2 is connected to line L1. This provides another circuit between lines L1 and L2.

The second toilet 11 is provided with a switch 2FTS having a pair of normally open contacts 2FTS-1 and 2FTS-2 (subcircuits 15 and 17, respectively). The flush valve 13 of this other toilet 11 has a solenoid 2SOL (subcircuit 17) and for this second toilet 11 there is provided a second macerator/transfer pump 12 having a starter relay 2M with overload thermal contacts 2OL (subcircuit 13). The coil 2CR and a counter 2K are in parallel with overload contacts 2OL and relay 2M (subcircuits 12 and 14). All of these parallel subcircuits are in series with contact 2FTS-2 that is in parallel with a normally open contact 2CR-1 of relay having a coil 2CR that connects these parallel subcircuits to line L1 by contact 2FTS-2 or contact 2CR-1. A normally open contact 2CR-2, of the relay having coil 2CR, is in subcircuit 11 in series with a coil 2TD of a time-delay relay. The contact 2FTS-1 is in series with solenoid 2SOL in subcircuit 17. The contacts 2FTS-1 and 2FTS-2 are connected at line 16 to line L1. The time-delay relay, having coil 2TD, has a normally open contact 2TD-1 (subcircuit 18) in parallel with contact 2FTS-2 and in series with solenoid 2SOL. It is seen that the circuitry for the operation of the two flush valves 13 and the two macerator/transfer pumps 12 are duplicates.

The circuit 19 includes in series a normally open contact 1TD-2, of the relay having coil 1TD (subcircuit 10), and a coil 3TD of a time-delay relay that has normally closed contact 3TD-1 in subcircuit 8. The subcircuit 20 includes a normally open contact 2TD-2, of the time-delay relay having coil 2TD (subcircuit 11). The subcircuit 20 is in parallel with contact 1TD-2 of circuit 19 so that the closing of contact 1TD-2 or contact 2TD-2 after the delay set for the corresponding relay energizes coil 3TD.

The circuit 21 includes, in series, pressure switch 1PS and a coil 1LR of a latch relay. That latch relay includes normally closed contact 1LR-1A (subcircuit 8) and a normally open contact 1LR-1B (circuit 24) that are opened and closed, respectively, when the latch relay is set and that are closed and opened, respectively, when the latch relay is reset. The subcircuit 22 has a normally open contact 4TD-1A in parallel with switch 1PS and subcircuit 22 is connected to coil 1LR. When contact 4TD-1 is closed after a delay, determined by the relay having coil 4TD following the energization of coil 4TD (subcircuit 24), coil 1LR is energized to reset the relay having coil 1LR.

The subcircuit 23 includes in series a normally closed contact 4TD-1B (of the relay having coil 4TD), thermal overload contacts 3OL, and a coil 3M of a starter relay for the motor of transfer pump 22. The circuit 24 includes, in series, coil 4TD, a normally closed contact 2LR-1 and a normally open contact 1LR-1B. The subcircuit 23 is in parallel with coil 4TD and is connected to contact 2LR-1. When the latch relay having coil 1LR is set by the closing of switch 1PS, normally closed contact 1LR-1A (subcircuit 8) opens to stop the motor of pump 12 and contact 1LR-1B closes to energize coil 4TD and coil 3M that starts the motor of transfer pump 22. The subcircuits 25, 26 and 27 contain a counter 3K, a coil 3CR of a relay, and coil 1TR of a timer relay, respectively, in parallel with coil 4TD and with overload contacts 3OL and coil 3M of circuit 23. Thus each of these three parallel subcircuits provides a separate circuit with contact 2LR-1 and contact 1LR-1B. The subcircuit 26 includes in series with coil 3CR a normally open contact 1TR-1 of the relay having coil 1TR. The contact 1TR-1 provides with the three parallel circuits mentioned above and with coil 4TD additional circuits.

The contact 1LR-1B closes, when the latch relay having coil 1LR is set by the closing of switch 1PS. When contact 1LR-1B closes, coil 3M of transfer pump 22 is energized and coils 4TD, 3CR and 1TR are energized. Also a count is entered by each energization of coil 3K that indicates the number of times that pump 22 has operated. The contact 2LR-1 is a contact of the latch relay having coil 2LR (circuit 32). The contact 2LR-1 is normally closed i.e., it is closed when the latch relay is reset. It is opened when the latch relay is set and stays open until the latch relay is reset. The contact 2LR-1 is opened when that latch relay is set by the closing of a normally open contact 4TD-2 in series with coil 2LR (circuit 32). This opening of contact 2LR-1 occurs after a preset time delay that starts with the energization of coil 1LR by the closing of switch 1PS. The coil 3M is then deenergized to stop pump 22 because contact 4TD-1B opens when contacts 4TD-1A and 4TD-2 close. However, the energization of coils 3CR and 4TD continue because coil 1TR is energized when contact 1LR-1B closes and that results in a closing of contact 1TR-1 that times out to open after a predetermined time subsequent to the opening of contact 2LR-1 that occurs before contact 1LR-1B opens when the latch relay having coil 1LR is reset.

The circuit 28 includes in series a normally open contact 3CR-1A and motor 1VM that operates inlet valve 25. The subcircuit 29 has a normally closed contact 3CR-1B in parallel with contact 3CR-1A of circuit 28. The contact 3CR-1B is connected to motor 1VM to provide a circuit.

When coil 3CR is energized, contact 3CR-1A of the same relay is closed to operate motor 1VM for an opening of valve 25. After a predetermined time delay following the stopping of pump 22, coil 3CR is deenergized by the opening of contact 1TR-1 by the timing out of the timer relay having that contact and coil 1TR. The contact 3CR-1A opens and contact 3CR-1B closes. When contact 3CR-1B cloes, motor 1VM is operated to close valve 25. The motor 1VM is a motor of conventional construction that includes circuitry such that, when there is the closing of contact 3CR-1A or contact 3CR-1B, there is a 90° rotation of the rotor of valve 25 for the opening or closing, respectively, of valve 25 and the operation of motor 1VM ceases. This stopping of motor 1VM occurs even though the closed contact, that provided this 90° rotation, remains closed.

The circuit 30 includes in series a normally open contact 3CR-2 of the relay having coil 3CR, and solenoid 3SOL of vent valve 28. The subcircuit 31 has a normally open contact 2TR-2 in parallel with contact 3CR-2 of circuit 30. Thus contact 2TR-2 is in series with solenoid 3SOL and provides a second circuit to energize coil 3SOL. When coil 3SOL is energized, valve 28 is opened.

The contact 3CR-2 closes when coil 3CR (subcircuit 26) is energized. The contact 3CR-2 remains closed and coil 3SOL remains energized during the period of time that coil 3M is energized for operation of transfer pump 22 and for the continued energization of coil 3CR until the relay having coil 1TR times out to open contact 1TR-1. Accordingly, vent valve 28 is open while waste is being pumped from collection tank 19 to sterilization tank 26. The contact 2TR-2 is closed when a coil 2TR (subcircuit 45) of the same timer relay is energized. At the end of the preset time of that timer relay, contact 2TR-2 opens. The coil 2TR is energized when the sterilization in tank 26 has been completed. Thus solenoid 3SOL is energized this second time to open valve 28 at the initiation of the discharge of sterilzation waste from tank 26. The solenoid 3SOL remains energized, so that valve 28 remains open, until the time of discharge has been completed. This time of discharge is described later.

The circuit 32 includes in series a normally open contact 4TD-2, of the time-delay relay having coil 4TD (subcircuit 24), and a coil 2LR of a latch relay. After coil 4TD is energized and after a preset time-delay, contact 4TD-2 closes to energize coil 2LR to set that latch relay. This results in the opening of normally closed contact 2LR-1. However, contact 1TR-1 remains closed until the completion of the preset time of the timer relay having that contact and coil 1TR.

A subcircuit 33 has a normally open contact 6TD-1 of a time-delay relay having coil 6TD (circuit 46). After coil 6TD is energized, as described below, and after the preset delay of the relay containing it, contact 6TD-1 closes to energize coil 2LR for a resetting of the latch relay containing coil 2LR. This closing of contact 6TD-1 occurs when the period of time of sterilization of the waste in tank 26, beginning at the time that the waste reaches the predetermined temperature, has been completed and the waste is to be discharged.

The circuit 35 includes in series a normally closed contact 1TS-1 of a thermal switch 1TS that monitors the temperature of waste in tank 26, a normally closed pressure switch 2PS mounted on pipe 27, a coil 4CR of a relay, and a normally closed switch 3LR-1A of a latch relay having a coil 3LR (circuit 37). The switch 3LR-1A is closed when that latch relay is reset.

The relay having coil 4Cr has normally open contacts 4CR-1 and 4Cr-2 that are in series in circuit 49 with a heater 1H of electric immersion heater 35 between these two contacts that are connected to lines L1 and L2, respectively. The energization of coil 4CR closes contacts 4CR-1 and 4Cr-2 to start the operation of heater 1H. When coil 4Cr is later deenergized, contacts 4CR-1 and 4CR-2 open so that heater 1H is shut off.

At the start of the use of the system the latch relay having coil 3LR is set, whereby contact 3LR-1A is open and contact 3LR-1B (circuit 40) is closed.

The contact 3Lr-1A is open until coil 3Cr (subcircuit 26) is energized. This occurs when contact 1LR-1B closes to energize coil 3CR and coil 3M. The energization of coil 3M starts motor of transfer pump 22 to transfer macerated flushed waste from collection tank 19 to sterilization tank 26. The energization of coil 3CR closes contact 3CR-1A to operate valve motor 1VM to open valve 25.

The subcircuit 34 has a light 2LT in parallel with coil 4CR of circuit 35. The subcircuit 34 is connected to pressure switch 2PS and to 3LR-1A so that light 2LT is on while coil 4CR is energized to turn heater 35 on.

The subcircuit 36 has an elapsed time indicator ETI that is also connected to switch 2PS and to contact 3LR-1A and is in parallel with coil 4CR. The indicator ETI is present merely to record the elapsed time that heater 1H is energized.

The circuit 37 includes in series a normally open contact 1TS-2 of thermal switch 1TS and coil 3LR of the latch relay having normally closed contact 3LR-1A (circuit 35). When contact 1TS-2 closes it energizes coil 3LR to set that latch relay. This occurs when the temperature of waste in tank 26 rises to the predetermined temperature. When coil 3LR is set, contact 3LR-1A opens. When the waste in tank 26 reaches that predetermined temperature to operate switch 1TS, contact 1TS-1 opens to deenergize coil 4CR. As a result contacts 4CR-1 and 4CR-2 open and heater 1H is thereby shut off.

In the system of the invention the heated waste is retained in tank 26 for a predetermined period of time after heater 1H is shut off. This is to provide a proper degree of sterilization of the waste. During that time the temperature may drop and thereby switch 1TS will operate to close contact 1TS-1. This would turn on heater 1H except for the fact that contact 3LR-1A was opened by the closing of contact 1TS-2 to set the latch relay having coil 3LR at the time that contact 1TS-1 was opened.

The subcircuit 38 has a normally open contact 3CR-3 of coil 3CR (subcircuit 26). The contact 3CR-3 is in parallel with contact 1TS-2. The contact 3CR-1 is connected to line L1 and to coil 3LR to reset the latch relay having that coil when contact 3CR-3 closes. However, this resetting of the latch relay does not occur until coil 3CR (subcircuit 26) is energized, to close contact 3CR-3, at the next cycle of operation of transfer pump 22.

The circuit 40 includes in series a normally closed contact 4LR-1A of a latch relay having a coil 4LR (circuit 42), a normally open contact 2LR-2 of the latch relay having coil 2LR (circuit 32), a counter 4K, and a normally open contact 3LR-1B of the latch relay having coil 3LR (circuit 37). As seen in FIG. 3, contact 4LR-1A opens when coil 4LR is energized to set that latch relay while contacts 2LR-2 and 3LR-1B are closed when coils 2LR and 3LR, respectively, are energized to set the latch relays having those contacts. The counter 4K merely counts the number of sterilizing operations performed in tank 26.

The subcircuit 39 has a light 3LT in parallel with counter 4K while subcircuit 41 merely has a coil 5TD of a time-delay relay in parallel with counter 4K. Thus light 3LT and coil 5TD are in circuits including in series contacts 4LR-1A, 2LR-2 and 3LR-1B.

The contact 2LR-2 is closed when contact 4TD-2 closes to energize coil 2LR (circuit 32) to set the latch relay having coil 2LR. This occurs at the completion of the operation of transfer pump 22. This is at the start of the operation of heater 35. The contact 2LR-2 remains closed until the sterilization is completed as described later. When the heater 35 raises the temperature to the predetermined temperature, contact 1TS-2 closes to set the latch relay having coil 3LR (circuit 37). This closes contact 3LR-1B. The three circuits containing light 3LT, counter 4K, and coil 5TD are now closed. The light 3LT is lit to indicate that the sterilization operation is in process. The coil 4K counts the number of sterilizing steps performed by the system. The coil 5TD is energized to start the timing of the time-delay relay of which it is a part. At the end of the preset time of that relay there is a closing of its normally open contact 5TD-1 which is in circuit 42 in series with a coil 4LR of a latch relay that is then set. The contact 4LR-1A then opens to turn off light 3LT and to deenergize coil 5TD. This opens contact 5TD-1 but the latch relay having coil 4LR is latched in set condition. Contact 4LR-1A (circuit 40) of that latch relay remains open.

The circuit 46 includes in series a normally open contact 4LR-1B of the latch relay having coil 4LR (circuit 42), a coil 6TD of a time-delay relay, a velocity switch 1VS, and a switch 1SW. The velocity switch 1VS is present in the circuitry when the system is used in a mobile vehicle, such as a passenger railroad car, and is constructed to close when the car is moving at a speed of at least a predetermined minimum velocity. The velocity switch 1VS is present to prevent the discharge of sterilized waste from tank 26 except when the car is moving at sufficient speed to discharge the waste along a sufficient length of travel. The switch 1SW is closed at the time that circuit breaker 1CB has its contacts closed so that the discharge step of the operation of the system can function. However, switch 1SW can be opened to prevent such discharge even though the cars are moving at sufficient velocity if the place of discharge is not suitable for any reason. Accordingly, in the normal use of the system switch 1SW is closed.

The subcircuit 45 includes, in parallel with coil 6TD, a coil 2TR of a timer relay having a normally open contact 2TR-1A (circuit 47), a normally closed contact 2TR-1B (subcircuit 48), and normally open contact 2TR-2 (subcircuit 31). The coil 2TR is connected to contact 4LR-1B and to switch 1VS so that coil 2TR is energized when contact 4LR-1B is closed, i.e., after the completion of the sterilization, provided switch 1VS is closed. The energization of coil 2TR closes contact 2TR-2 to energize solenoid 3SOL so that valve 28 is opened for a venting of tank 26. At the same time coil 2TR-1A closes to energize valve motor 2M for a 90° rotation of the rotor of valve 32 for its opening to discharge sterilized waste from tank 26. At the time that contact 2TR-1A is closed to open valve 32, contact 2TR-1B is opened. This operation to open valve 32 occurs because contact 2TR-1A is in series with motor 2VM in circuit 47. The contact 2TR-1B (subcircuit 48) is in parallel with contact 2TR-1A and is connected to line L1 and motor 2VM. The valve motor 2VM is constructed like valve motor 1VM described earlier.

The subcircuit 44 contains a light 4LT, that is in parallel with coil 6TD, switch 1VS and switch 1SW, so that it is lit, when contact 4LR-1B closes, to indicate that the sterilization has been completed. The light 4LT is lit when contact 2LR-1B is closed due to the completion of the preset time of sterilization, even though the car is not moving at a sufficient speed for switch 1VS to be closed to energize the timer relay having coil 2TR.

At the end of the preset time of the timer relay having coil 2TR, contact 2TR-2 (subcircuit 31) opens to cease energization of solenoid 3SOL so that vent valve 28 closes. Also at the end of this preset period of time, contact 2TR-1B closes to operate valve motor 2VM for a 90° rotation of valve 32 for a closing of that valve. The discharge from tank 26 is now completed and that tank is now ready to receive flushed waste from tank 19.

The time-delay relay having coil 6TD times out after the completion of the preset time of the timer relay having coil 2TR. At the completion of that preset time of the time-delay relay having coil 6TD, contact 6TD-2 (subcircuit 43) closes to energize coil 4LR for a resetting of the latch relay having coil 4LR. This results in an opening of contact 4LR-1B and a closing of contact 4LR-1A.

Illustratively, the timer relay having coil 2TR times out after 9.5 minutes to close valve 32 while the time-delay relay having coil 6TD has a preset delay of 10 minutes after which contact 6TD-1 resets the latch relay having coil 2LR that, when reset, closes contact 2LR-1. In the event that tank 19 has already accumulated a sufficient new quantity of waste to close switch 1PS for a closing of contact 1LR-1B, this closing of contact 2LR-1 would start the transfer of waste to tank 26 before valve 32 is closed if timer relay having coil 2TR did not time out before the preset time of delay for the time-delay relay having coil 6TD. It is necessary to close valve 32 before operating pump 22 to avoid discharge of waste that has not been sterilized.

After the delay of the relay having coil 6TD and a sufficient accumulation of flushed waste in tank 19 to close pressure switch 1PS (circuit 21) there is started a new cycle of operation of transferring waste from tank 19 to tank 26, of heating and sterilizing waste in tank 26, and of discharging the sterilized waste from tank 26.

For simplicity, the resistance 1H of heater 35 is shown in FIG. 3 connected by contacts 4CR-1 and 4CR-2 to lines L1 and L2 that are provided with 120 VAC. Actually, in the preferred embodiment the contacts 4CR-1 and 4CR-2 are connected through fuses to two lines of a 480 VAC, 60 Hertz, three-phase electric source to provide a greater heat input to heater 35.

In FIG. 3, foot switches 1FTS and 2FTS are shown as having normally open contacts. In the preferred construction these contacts are normally closed but are held open by cam contact with pedals 14 when pedals 14 are in their raised positions.

The coils 1M, 2M and 3M of starter relays for the motors of pumps 12 and 22, when energized, operate these relays to close their normally open contacts connected in a conventional manner to these motors and to lines of the 480 VAC, 60 Hertz, three-phase electric source, mentioned above, to operate the motors.

In view of the foregoing description of FIG. 3 the overall toilet system operates in the following manner. At the start of the use of the system for an initial period of service, the latch relays having coils 1LR, 2LR, and 4LR are in the reset condition and the latch relay having coil 3LR is in the set condition. As a result, contact 1LR-1A is closed, contact 1LR-1B is open, contact 2LR-1 is closed, contact 2LR-2 is open, contact 3LR-1A is open, 3LR-1B is closed, contact 4LR-1A is closed, and contact 4LR-1B is open. The circuit breaker 1CB is operated to close its contacts so that 120 VAC is provided to lines L1 and L2. Only light 1LT is lit at this time. The switch 1SW is closed. A small quantity of flush water is added to the bowl of toilet 11.

Although FIG. 3 illustrates the preferred embodiment over the whole toilet system using two toilets 11 with their foot pedals 14 to operate the dump valve of the associated toilet and with flush valve 13 of each, along with the associated macerator/transfer pump 12, the description that follows is limited for simplicity to the use of one of these toilets and pumps.

After a person uses toilet 11 he depresses pedal 14 to open the dump valve and at the same time to operate switch 1FTS to close contacts 1FTS-1 and 1FTS-2. The closing of contact 1FTS-1 energizes solenoid 1SOL of flush valve 13 to initiate the opening of that valve to provide a limited amount of flush water to the toilet 11. Illustratively valve 13 when open for its predetermined time provides a pint of flush water. As soon as the person depressing foot pedal 14 notes that the bowl of toilet 11 has been satisfactorily flushed he can remove his foot from pedal 14 and thereby close the dump valve even though the limited supply of flush water by valve 13 may not have been completed. The balance, if any, of the flush water would merely accumulate in the bottom of the bowl 11 above the now closed dump valve. If the person had continued to depress pedal 14 the flush valve 13 would not operate again to provide an additional quantity of flush water.

At the time that pedal 14 is depressed to operate switch 1FTS, the closing of contact 1FTS-2 energizes coil 1CR to close contact 1CR-1 of the holding circuit and close contact 1CR-2 that energizes coil 1TD of a time-delay relay. The closing of contact 1FTS-2 also energizes coil 1M to start the operation of the motor of macerator/transfer pump 12. Even though the person removes his foot from pedal 14 to permit it to automatically return to its elevated position so that contact 1FTS-2 opens, the now closed contact 1CR-1 of the holding circuit continues the operation of the motor of pump 12 and continues the energization of coil 1CR so that contact 1CR-2 remains closed whereby the time-delay relay having coil 1TD continues to operate. At the end of the preset delay of that time-delay relay it closes its contacts 1TD-1 and 1TD-2.

This closing of contact 1TD-1 energizes again solenoid 1SOL for a second operation of flush valve 13 to provide flush water to the bowl of toilet 11 so that the toilet has a pool of water in the bottom of the bowl to be ready for a subsequent use of the toilet. The closing of contact 1TD-2 causes the operation of another time-delay relay having coil 3TD that opens contact 3TD-1 after a predetermined period of time to deenergize coil 1CR. The opening of contact 3TD-1 also a deenergized coil 1M so that the motor of pump 12 stops. The preset time delays of the two relays having coils 1TD and 3TD total an illustrative period of time of 15 seconds that is adequate to transfer flushed waste to collection tank 19.

The foregoing cycle of use of toilet 11 is repeated until the accumulated quantity of flushed waste in tank 19 causes the closing of pressure switch 1PS. At the start of the use of the system in the invention tank 19 merely contains air. As flushed waste is transferred to tank 19, the air in that tank is compressed in the upper portion of tank 19. When the pressure of the air increases to a predetermined value, the pressure closes switch 1PS. This use of pressure switch 1PS, as the sensing means operative in response to a condition provided by an accumulation of flushed waste in the collection tank, is preferred to other sensing means, such as a level sensing switch, because the latter can become inoperative more readily than a pressure switch due to various factors. One factor is the fact that a level sensing switch is operated mechanically by the flushed waste in tank 19.

When using the pressure switch, which is the case in the preferred embodiment, to sense the increase in pressure of air in the top portion of tank 19, the system remains operative even though part or all of the air is lost due to leakage from the tank. In that case the volume of flushed waste in tank 19 increases to the top of the tank and at that time the flushed waste provides a hydraulic pressure due to the pressure of pump 12 whe it is operating in an attempt to transfer flushed waste to a full tank 19. When pressure switch 1PS is closed, it sets the latch relay having coil 1LR and this opens contact 1LR-1A to prevent the operation of pump 12, by the operation of switch 1FTS, during the time that this latch relay is set.

The closing of pressure switch 1PS to set the latch relay, having coil 1LR, closes its contact 1LR-1B to energize coil 3M to operate transfer pump 22. At the same time coil 3CR and coil 1TR are energized. The energization of coil 3CR closes contact 3CR-1A and opens 3CR-1B. The energization of coil 1TR closes contact 1TR-1 of the timer relay having coil 1TR to provide a holding circuit for coils 3CR and 1TR. The closing of contact 3CR-1A causes the operation of valve motor 1VM to open valve 25 so that it is open while transfer pump 22 is operating for the transfer of flushed waste from collection tank 19 to sterilization tank 26. During this period of time that coil 3CR is energized, contact 3CR-2 is closed to energize solenoid 3SOL so that vent valve 28 is now open to vent vapors from tank 26 while it is receiving flushed waste from tank 19.

At the time that coils 3M, 3CR and 1TR are energized, coil 4TD of a time-delay relay is energized. At the end of the preset time of that relay, contact 4TD-1B opens and contact 4TD-1A closes. When contact 4TD-1B opens, coil 3M is deenergized and the motor of transfer pump 22 stops. The preset time of the time-delay relay having coil 4TD thus determines the period of time that pump 22 operates. The coils 4TD, 3CR and 1TR remain energized even though contact 4TD-1B opens to deenergize coil 3M, because these three coils are connected directly to line L1 instead of through contact 4TD-1B. The continued energization of coil 4TD keeps contact 4TD-1B open. The continued energization of coil 3CR keeps contact 3CR-1B open so that inlet valve 25 remains open. The continued energization of coil 3CR also keeps contact 3CR-2 closed so that solenoid 3SOL remains energized and thereby vent valve 28 remains open. When the relay having coil 4TD closes contact 4TD closes contact 4TD-1A, the latch relay having coil 1LR is reset to close contact 1LR-1A. A subsequent closing of contact 1FTS-2 by the depression of pedal 14 initiates the operation of the motor of macerator/ transfer pump 12.

The preset time of the timer relay having coil 1TR determines the period of time that coil 3CR remains energized. When the period of time is completed, coil 3CR is deenergized so that contact 3CR-1B closes to operate valve motor 1VM to close valve 25, and so that contact 3CR-2 opens to deenergize solenoid 3SOL whereby vent valve 28 is closed.

The timed period of operation of pump 22 provides a transfer from tank 19 to tank 26 of a predetermined amount of flushed waste. During the period of time the amount of flushed waste transferred is preferably equivalent to approximately the capacity of tank 19. The capacity of tank 26 is preferably about the capacity of tank 19. By means of this circuitry for timed transfer it is unnecessary to have in tank 26 any level-sensing means, i.e., a liquid level switch, that, when operated, would stop the transfer of flushed waste from tank 19 to tank 26.

At the time that coil 3CR is energized, i.e., when switch 1PS is closed to set the latch relay having coil 1LR, the relay having coil 3CR closes its contact 3CR-3 to reset the latch relay having coil 3LR, if contact 1TS-2 is open, whereby contact 3LR-1A closes and contact 3LR-1B opens. As a result of the closing of contact 3LR-1A, coil 4CR is energized to close contacts 4CR-1 and 4CR-2 to provide current to resistance 1H of heater 35. Thus heater 35 starts to raise the temperature of flushed waste in tank 26 while the waste is being transferred from tank 19, if contact 1TS-2 is open. The heater 35 continues to operate until the temperature rises to a predetermined minimum temperature at which time thermal switch 1TS operates to open its contact 1Ts-1 and to close its contact 1TS-2. The opening of contact 1TS-1 deenergizes coil 4CR to open contacts 4CR-1 and 4CR-2 to stop the operation of heater 35. At that time the closing of contact 1TS-2 sets the latch relay having coil 3LR whereby contact 3LR-1B closes.

The contact 2LR-2, in series with contact 3LR-1B and coil 5TD, closed when the latch relay having coil 2LR (circuit 32) was set by the closing of contact 4TD-2. That occured after the preset time following the energization of coil 4TD by the closing of pressure switch 1PS to initiate the operation of pump 22 and the opening of valves 25 and 28. As a result of the closing of contact 3LR-1B, coil 5TD of its time-delay relay is energized. After the preset time of that relay, its contact 5TD-1 closes to set the latch relay having coil 4LR and contact 4LR-1A (circuit 40). This setting of that latch relay opens contact 4LR-1A in series with coil 5TD so that contact 5TD-1 opens. Of course, the latch relay having coil 4LR remains in set condition. When the latch relay having coil 4LR is set by the closing of contact 5TD-1 after the preset delay of the relay having coil 5TD, contact 4LR-1B (circuit 46) closes to energize coil 6TD to start the timing of time-delay relay having coil 6TD. The closing of contact 4LR-1B also energizes the coil 2TR of a timer relay.

When coil 2TR is energized, contact 2TR-1A closes to operate valve motor 2VM so that valve 32 opens to start the discharge of sterilized waste from tank 26. At that time contact 2TR-1B opens but it closes when the timer relay, having coil 2TR, times out. This later closing of contact 2TR-1B (with concomitant opening of contact 2TR-1A) operates valve motor 2VM to close discharge valve 32. The time that valve 32 is open is thus determined by the preset time of the timer relay having coil 2TR.

When the preset time delay of the time-delay relay having coil 6TD is completed, contact 6TD-2 closes to reset the latch relay having coil 4LR. The contact 4LR-1B thus opens to deenergize coils 2TR and 6TD. As a result of the deenergization of coil 2TR, contact 2TR-1B closes and contacts 2TR-1A and 2TR-2 open. When contact 2TR-2 opens, solenoid 3SOL is deenergized, the vent valve 28 closes. When contact 2TR-1B closes, discharge valve motor 2VM operates to close valve 25.

Because the time-delay relay having coil 6TD does not time out until a short period after the time relay having coil 2TR times out (illustratively one-half minute after the latter relay times out), coil 2TR remains energized for this additional time. In addition, until contact 6TD-1 closes to reset the latch relay having coil 2LR, contact 2LR-1 (circuit 24) remains open. The contact 2LR-1 closes only after valve 32 has closed. Thus coil 3M cannot be energized to operate pump 22 until valves 28 and 32 are closed.

From the foregoing description of the operation of the system of the invention it is seen that, in addition to the reset time that pump 22 operates and valve 25 is open for a transfer of predetermined quantity of flushed waste from tank 19 to tank 26, the electrical controls of the system provide a sensing of the temperature of the flushed waste in tank 26 to initiate a predetermined holding time in tank 26 followed by an operation of discharge valve 32 to open it for a predetermined period of time.

In one use of the system of the invention, a relatively large number of toilets 11 through their associated macerator/transfer pumps 12 will provide flushed waste to the same collection tank 19. In that use there could be a relatively rapid accumulation of new flushed waste in tank 19 to close switch 1PS that results in the setting of the latch relay having coil 1LR to close contact 1LR-1B. The contact 2LR-1 is not closed until the relay having coil 6TD times out to reset the latch relay having coil 2LR. Although discharge valve 32 is now closed when contact 2LR-1 closes to initiate the operation of pump 22 for a transfer of waste from tank 19 to tank 26, the transfer of this waste may not cool switch 1TS sufficiently fast to operate it for an opening of contact 1TS-2. This could happen if switch 1TS is mounted on the outside surface of tank 26 as is the case for the construction using a conventional switch 1TS, whereby switch 1TS is mounted on the outside wall of tank 26 and is surrounded by insulation that is provided around tank 26. In this event of insufficient rate of cooling of switch 1TS, it could continue in the condition in which contact 1TS-2 is still closed while coil 3CR is energized during the energization of coil 3M to operate pump 22. If coil 3CR were deenergized when coil 3M is deenergized to stop the motor of pump 22, contact 3CR-3 would open while contact 1TS-2 is still closed. The contact 3CR-3 when closed cannot reset the latch relay having coil 3LR while that latch relay is connected to line L1 by a still closed contact 1TS-2. To keep contact 3CR-3 closed until after contact 1TS-2 opens, so that the latch relay having coil 3LR will be set to close contact 3LR-1A to start the operation of heater 35, the preferred circuitry of the invention that is shown in FIG. 3 provides for the continued energizaton of coil 3CR for a sufficient period of time after coil 3M is deenergized, during which there is adequate cooling of switch 1TS by the new quantity of waste in tank 26 to open contact 1TS-2. Thus in this preferred circuitry, that is especially important when the system is used with a relatively large number of toilets providing waste to the same collection tank, heater 35 is turned on shortly after the transfer of waste from tank 19 to tank 26 is completed.

In the event that only one or a very small number of toilets 11 are connected through the associated macerator/ transfer pump 12 to the same collection tank, the circuitry of FIG. 3 can be modified to preset the time for the relay having coil 1TR to be essentially that of the preset time of the relay having coil 4TD. In that modification thermal overload contacts 30L and coil 3M (subcircuit 23) are connected directly to line L1 rather than through normally closed contact 4TD-1B that would not be present. In that construction, heater 35 is turned on when pump 22 starts operating. That modification would be dependent upon the use of a thermal switch 1TS inside tank 26 where it would be rapidly cooled by the new quantity of waste from tank 19 for a prompt opening of contact 1TS-2. However, it is seen that this modification is dependent upon prompt operation of switch 1TS to open contact 1TS-2. As a result the circuitry of the preferred embodiment shown and described is preferable even for the use when one or a few toilets provide waste to the same collection tank.

In the preferred embodiment of the sterilizer sewage treatment system of the invention, that has been described above, the sewage illustratively in the form of flushed waste from toilets is marcerated while being fed to collection tank 19. It is desirable but not necessary that tank 19 receive waste that has been macerated. The maceration preferably precedes the sterilization treatment, that occurs in tank 26. Instead the discharged sterilized waste can be the material that is macerated. Accordingly, the pump to transfer sewage to tank 19 can be merely a transfer pump rather than a macerator/transfer pump. In that construction the transfer pump between tanks 19 and 26 may be macerator/ transfer pump. In such construction the pump that transfers flushed waste from a toilet to tank 19 could be a vacuum pump that would provide positive displacement of the flushed waste from the pump to collection tank 19.

In view of the foregoing contemplated alternative constructions of the system of the invention, the system in its broadest aspect includes: a collection tank having an inlet, to receive waste, and an outlet; transfer pump means connected to the outlet of the collection tank; a sterilization tank; power-operated valved transfer means connected to an inlet of the sterilization tank and to the outlet of the pump means that is connected to the outlet of the collection tank; heater means on the sterilization tank; power-operated valved discharge means connected to an outlet of the sterilization tank; and the electrical control means that has been described with respect to the initiation and operation of the transfer pump means, of the transfer pump means between the tanks, of the power-operated valved transfer means between the tanks, of the power-operated valved discharge means and of the heater means.

From the foregoing description of the electrical controls shown in FIG. 3 and the subsequent description of the operation of the overall toilet system, it is seen that the relay having coil 5TD has a preset time before contact 5TD-1 is closed to initiate the opening of discharge valve 32. The timing of that relay is initiated by the energization of coil 5TD when contact 1TS-2 closes due to the waste in tank 26 reaching the predetermined temperature. This preset time of delay of the relay having coil 5TD is illustratively 30 minutes from the time that contact 1TS-2 closes when thermal switch TS is closed due to waste in tank 26 being raised to a temperature of about 260° F.

A test indicated that macerated flushed toilet waste would be adequately sterilized to destroy bacteria when it is heated at 260° F. for 30 minutes. In that test about 2.5 gallons of toilet waste taken from a sewage pit was blended with fresh feces and diluted to 30 gallons using tap water. The resulting mixture imitates the composition of flushed toilet waste collected through a period of time by the use of a toilet for about one day. Samples of the untreated and heat-treated mixtures were tested by standard multiple tube fermentation techniques to determine the total viable organism and the coliform bacteria densities. The densities of bacteria were expressed as the most probable number per 100 ml of sample. The bacterial densities of the mixture before heat treatment were $2.7 \times 10^8$ for total viable organisms and $1.5 \times 10^8$ for coliform bacteria. The samples after the heat treatment had a bacterial density of less than 2.2 for total viable organisms and coliform bacteria.

The time of heat treatment for sterilization is inversely proportional to the temperature to which waste is essentially maintained in tank 26 that is insulated to reduce the cooling of waste, during the delay period of the relay having coil 6TD, after heating 35 is shut off.

The foregoing description has been presented solely for the purpose of illustration and not by way of limitation of the invention because the latter is limited only by the claims that follow

We claim:

1. A sterilizer sewage treatment system useful in an overall toilet system to collect, treat and discharge toilet waste, which comprises:

a collection tank having an inlet, through which liquid sewage is fed to said collection tank, and an outlet;

a sterilization tank having an inlet and an outlet;

transfer pump means connected to said outlet of said collection tank;

power-operated valved transfer means connected to said transfer pump means and said inlet of said sterilization tank;

power-operated valved discharge means connected to said outlet of said sterilization tank;

heater means mounted on said sterilization tank; and electrical means to control and operate said transfer pump means, said power-operated valved transfer means, said power-operated valved discharge means and said heater means, said electrical means including:

sensing means mounted on said collection tank and operative in response to a condition provided by a predetermined accumulation of liquid sewage received in said collection tank;

means responsive to the operation of said sensing means to operate said power-operated valved transfer means for an opening of its valve to communicate said transfer pump means with said sterilization tank for a predetermined period of time and then to close that valve;

means responsive to the operation of said sensing means to initiate the operation of said transfer pump means;

means responsive to the operation of said sensing means to prevent continued operation of said transfer pump means after a predetermined period of time of operation so that the operation of said transfer pump means provides a predetermined amount of waste from said collection tank to said sterilization tank;

means responsive to the operation of said sensing means to initiate the operation of said heater means;

temperature-sensing switch means operative in response to the temperature of the waste in said sterilization tank being raised to a predetermined temperature by said heater means, said switch means when operated being effective to cease the operation of said heater means;

timer means when initiated operates said power-operated valved discharge means to change its valve from an open position to a closed position or from a closed position to an open position;

first time-delay means initiated in response to the operation of said temperature-sensing switch means, when the waste in said sterilization tank reaches said predetermined temperature to operate said timer means, after a predetermined delay, to open said power-operated valved discharge means and, after a further delay, to close said power-operated valved discharge means; and second time-delay means initiated in response to the operation of said temperature-sensing switch means, when the waste in said sterilization tank reaches said predetermined temperature, to operate after a predetermined delay, during which said valve of said power-operated valved discharge means has opened and then closed, said means preventing the continued operation of said transfer pump means so that said transfer pump means can operate again whenever said sensing means is operative in response to said condition in said collection tank.

2. The system of claim 1 wherein:

said sterilization tank has a second outlet located at the top portion of that tank;

said system further includes power-operated valved vent means connected to said second outlet of said sterilization tank; and said electrical means further includes:

means responsive to the operation of said sensing means to operate said power-operated valved vent means for an opening of its valve to vent vapor from said sterilization tank for a predetermined period of time and then to close that valve, said period of time, during which said valve of said vent means is open, is at least for the period of time that said transfer pump means is operating; and means responsive to the operation of said first time-delay means to open, at the end of said predetermined delay of said first time-delay means, said valve of said vent means during the period of time that said valve of said power-operated valved discharge means is open so that said valve of said vent means is open during the discharge of waste from said sterilization tank.

3. The system of claim 1 wherein said sensing means mounted on said collection tank includes a pressure switch mounted in the top portion of said tank to be operated when air in said tank is sufficiently compressed by a predetermined accumulation of liquid sewage in said tank.

4. The system of claim 3 wherein:

said sterilization tank has a second outlet located at the top portion of that tank;

said system further includes power-operated valved vent means connected to said second outlet of said sterilization tank; and said electrical means further includes:

means responsive to the operation of said pressure switch to operate said power-operated valved vent means for an opening of its valve to vent vapor from said sterilization tank for a predetermined period of time and then to close that valve, said period of time, during which said valve of said vent means is open, is at least for the period of time that said transfer pump means is operating; and means responsive to the operation of said first time-delay means to open, at the end of said predetermined delay of said first time-delay means, said valve of said vent means during the period of time that said valve of said power-operated valved discharge means is open so that said valve of said vent means is open during the discharge of waste from said sterilization tank.

5. The system of claim 1 for its use in an overall toilet system on a railroad car, said system further including velocity switch means having a normally open switch that is closed in response to a minimum speed of the car, said velocity switch being connected to said timer means and said second time-delay means to prevent their operation except when said velocity switch is closed, so that if said velocity switch is open at the completion of said delay of said first time-delay means said timer means cannot operate to open the valve of said power-operated valved discharge means and then close it after a delay until the speed of the car is at least the minimum speed that causes the closing of the velocity switch and said second time-delay means is not initiated until such speed is reached.

6. The system of claim 5 wherein said sensing means mounted on said collection tank includes a pressure switch mounted in the top portion of said tank to be operated when air in said tank is sufficiently compressed by a predetermined accumulation of liquid sewage in said tank.

7. The system of claim 6 wherein:

said sterilization tank has a second outlet located at the top portion of that tank;

said system further includes power-operated valved vent means connected to said second outlet of said sterilization tank; and said electrical means further includes:

means responsive to the operation of said pressure switch to operate said power-operated valved vent means for an opening of its valve to vent vapor from said sterilization tank for a predetermined period of time and then to close that valve, said period of time, during which said valve of said vent means is open, is at least for the period of time that said transfer pump means is operating; and means responsive to the operation of said first time-delay means to open, at the end of said predetermined delay of said first time-delay means, said valve of said vent means during the period of time that said valve of said power-operated valved discharge means is open so that said valve of said vent means is open during the discharge of waste from said sterilization tank.

8. The system of claim 1 and further including macerator/transfer pump means connected to said inlet of said collection tank to feed said sewage as macerated sewage to said collection tank.

9. The system of claim 8 wherein said sensing means mounted on said collection tank includes a pressure switch mounted in the top portion of said tank to be operated when air in said tank is sufficiently compressed by a predetermined accumulation of liquid sewage in said tank.

10. The system of claim 9 wherein:

said sterilization tank has a second outlet located at the top portion of that tank;

said system further includes power-operated valved vent means connected to said second outlet of said sterilization tank; and said electrical means further includes:

means responsive to the operation of said pressure switch to operate said power-operated valved vent means for an opening of its valve to vent vapor from said sterilization tank for a predetermined period of time and then to close that valve, said period of time, during which said valve of said vent means is open, is at least for the period of time that said transfer pump means is operating; and means responsive to the operation of said first time-delay means to open, at the end of said predetermined delay of said first time-delay means, said valve of said vent means during the period of time that said valve of said power-operated valved discharge means is open so that said valve of said vent means is open during the discharge of waste from said sterilization tank.

11. The system of claim 10 for its use in an overall toilet system on a railroad car, said system further including velocity switch means having a normally open switch that is closed in response to a minimum speed of the car, said velocity switch being connected to said timer means and said second time-delay means to prevent their operation except when said velocity switch is closed, so that if said velocity switch is open at the completion of said delay of said first time-delay means said timer means cannot operate to open the valve of said power-operated valved discharge means and then close it after a delay until the speed of the car is at least the minimum speed that causes the closing of the velocity switch and said second time-delay means is not initiated until such speed is reached.

12. The system of claim 8 for its use in an overall toilet system, said system further including:

a toilet system having:

a toilet bowl;

a foot pedal;

switch means operated by the depression of said pedal;

flush valve means having a solenoid that, when energized, initiates a feeding of a limited quantity of flush water by said flush valve means, said solenoid being connected to said switch means to be energized when said foot pedal is depressed;

means responsive to the operation of said pedal-operated switch means to initiate the operation of said macerator/ transfer pump means;

third time-delay means initiated in response to the operation of said means, that is operated in response to the operation of said pedal-operated switch means to initiate the operation of said macerator/transfer means, to prevent after a predetermined period of time the continued operation of said macerator/transfer pump means, said third time-delay means being connected to said solenoid of said flush valve means to energize said solenoid, after a predetermined period of time of delay of said third time-delay means, to provide another limited quantity of flush water by said flush valve to said toilet; and means initiated in response to the operation of said sensing means to prevent the operation of said macerator/ transfer pump means for at least a part of the period of time that said transfer pump means is operating to transfer waste from said collection tank to said sterilization tank.

13. The system of claim 12 wherein said sensing means mounted on said collection tank includes a pressure switch mounted in the top portion of said tank to be operated when air in said tank is sufficiently compressed by a predetermined accumulation of liquid sewage in said tank.

14. The system of claim 13 wherein:

said sterilization tank has a second outlet located at the top portion of that tank;

said system further includes power-operated valved vent means connected to said second outlet of said sterilization tank; and said electrical means further includes:

means responsive to the operation of said pressure switch to operate said power-operated valved vent means for an opening of its valve to vent vapor from said sterilization tank for a predetermined period of time and then to close that valve, said period of time, during which said valve of said vent means is open, is at least for the period of time that said transfer pump means is operating; and means responsive to the operation of said first time-delay means to open, at the end of said predetermined delay of said first time-delay means, said valve of said vent means during the period of time that said valve of said power-operated valved discharge means is open so that said valve of said vent means is open during the discharge of waste from said sterilization tank.

15. The system of claim 14 for its use in an overall toilet system on a railroad car, said system further including velocity switch means having a normally open switch that is closed in response to a minimum speed of the car, said velocity switch being connected to said timer means and said second time-delay means to prevent their operation except when said velocity switch is closed, so that if said velocity switch is open at the completion of said delay of said first time-delay means said timer means cannot operate to open the valve of said power-operated valved discharge means and then close it after a delay until the speed of the car is at least the minimum speed that causes the closing of the velocity switch and said second time-delay means is not initiated until such speed is reached.

16. The system of claim 15 wherein said collection tank and said sterilization tank have about the same volumetric capacity.

17. The system of claim 16 wherein said means that prevents continued operation of said transfer pump means after a predetermined period of time of operation prevents this continued operation before the end of the predetermined period of time that said valve of said power-operated valved transfer means is open in response to the operation of said sensing means.

18. A sterilizer sewage treatment system useful in an overall toilet system to collect, treat and discharge toilet waste, which comprises:

a collection tank having an inlet, through which liquid sewage is fed to said collection tank, and an outlet;

a sterilization tank having an inlet and an outlet;

transfer pump means connected to said outlet of said collection tank and having a starter relay with a coil, said transfer pump means being operated while said coil is energized;

power-operated valved transfer means connected to said transfer pump means and said inlet of said sterilization tank and having a valve motor that operates when energized to open or close its valve;

power-operated valved discharge means connected to said outlet of said sterilization tank and having a valve motor that operates when energized to open or close its valve;

heater means mounted on said sterilization tank; and pressure switch means mounted in the top portion of said collection tank and including a pressure switch having a normally open contact that is closed in response to a predetermined pressure provided by an accumulation of liquid sewage received in said collection tank;

temperature-sensing switch means mounted on said sterilization tank and including a switch having a normally closed contact and a normally open contact that are opened and closed, respectively, in response to the temperature of the waste in said sterilization tank when it is raised to a predetermined temperature by said heater means;

a first latch relay having a coil and a normally open contact that is closed when said first latch relay is set;

a second latch relay having a coil, a normally closed contact and a normally open contact that are opened and closed, respectively, when said second latch relay is set;

a third latch relay having a coil, a normally closed contact and a normally open contact that are opened and closed, respectively, when said third latch relay is set;

a fourth latch relay having a coil, a normally closed contact and a normally open contact that are opened and closed, respectively, when said fourth latch relay is set;

a first relay having a coil, first and second normally open contacts, and a normally closed contact;

a second relay having a coil and first and second normally open contacts;

a first time-delay relay having a coil, a normally closed contact and first and second normally open contacts that, when said coil of said first time-delay relay is energized, are opened and closed, respectively, after a predetermined period of time;

a second time-delay relay having a coil and a normally open contact that, when the coil of the said second time-delay relay is energized, is closed after a predetermined period of time;

a third time-delay relay having a coil and first and second normally open contacts that, when said coil of said third time-delay relay is energized, are closed after a predetermined period of time;

a first timer relay having a coil and a normally open contact that is closed when said coil of said first timer relay is energized and remains closed for a predetermined period of time; and a second timer relay having a coil and a normally open contact and a normally closed contact that are closed and opened, respectively, when said coil of said second timer relay is energized, and remain closed and open for a predetermined period of time, in which:

said normally open contact of said pressure switch is connected to said coil of said first latch relay to set that relay when that contact closes;

said first normally open contact of said first time-delay relay is connected to said coil of said first latch relay to reset that relay when that contact closes;

said normally closed contact of said first time-delay relay is connected to said coil of said starter relay, that is connected to said normally closed contact of said second latch relay and to said normally open contact of said first latch relay, so that said transfer pump means operates when said normally open contact of said first latch relay closes until said normally closed contact of said first time-delay relay opens after a predetermined time to provide a predetermined time of operation of said transfer pump means;

said coils of said first relay, of said first time-delay relay, and of said first timer relay are connected to said normally closed contact of said second latch relay so that these coils are energized when said normally open contact of said first latch relay is closed and are connected to said normally open contact of said first timer relay that is closed, when said coil of said first timer relay is energized, to continue the energization of these coils after said normally open contact of said first latch relay opens, for a predetermined time of operation of said first relay;

said first normally open contact and said normally closed contact of said first relay are connected to said valve motor of said power-operated valved transfer means to operate that valve motor for opening and closing of said transfer means when said coil of said first relay is energized and then deenergized;

said second normally open contact of said first time-delay relay and said first normally open contact of said third time-delay relay are connected to said coil of said second latch relay to set that latch relay, when said second normally open contact of said first time-delay relay closes, and to reset that latch relay, when said first normally open contact of said third time-delay relay closes;

said normally open contacts of said second relay are connected to said heater means to operate that heater means when those contacts are closed; said normally closed contact of said temperature-sensing switch means being connected to said coil of said second relay that is connected to said normally closed contact of said third latch relay, so that said normally open contacts of said second relay are closed to operate said heater, when said coil of said second relay is energized by the closing of said normally closed contact of said third latch relay, until said normally closed contact of said temperature-sensing switch means opens;

said normally open contact of said temperature-sensing switch means and said second normally open contact of said first relay are connected to said coil of said third latch relay, so that said coil of that latch relay is set, when said normally open contact of said temperature-sensing switch means closes to open said normally closed contact of that latch relay to deenergize said coil of said second relay to turn off said heater means, and is reset, when said second normally open contact of said first relay closes, to close said normally closed contact of said third latch relay, to start the operation of said heater means when said coil of said first relay is energized and said normally open contact of said temperature-sensing switch means is in the open position;

said coil of said second time-delay relay is connected in series with said normally closed contact of said fourth latch relay, said normally open contact of said second latch relay, and said normally open contact of said third latch relay, so that said coil of said second time-delay relay is energized to close, after a predetermined period of time, said normally open contact of said second time-delay relay when said second and third latch relays are set and to open that contact when said fourth latch relay is set so as to provide a predetermined period of time during which the waste is maintained in said sterilization tank after said heater means is turned off;

said normally open contact of said second time-delay relay and said second normally open contact of said third time-delay relay are connected to said coil of said fourth latch relay to set and reset, respectively, that latch relay;

said coil of said second timer relay and said coil of said third time-delay relay are connected in parallel to each other and are connected in series to said normally open contact of said fourth latch relay, said coils being energized when said fourth latch relay is set at the completion of the time of maintenance of the waste in the sterilization tank following the operation of said temperature-sensing switch means to set said third latch relay;

said normally open contact and normally closed contact of said second timer relay are connected to said valve motor of said power-operated valved discharge means to operate that valve motor for opening and closing of said discharge means when said coil of said second relay is energized and then deenergized.

19. The system of claim 18 wherein:

said sterilization tank has a second outlet located at the top portion of that tank;

said first relay further includes a third normally open contact;

said second timer relay further includes a second normally open contact;

said system further includes power-operated valved vent means having a solenoid and connected to said second outlet of said sterilization tank, said third normally open contact of said first relay and said second normally open contact of said second timer relay being connected in parallel to each other and in series with said solenoid, so that said valved vent means is open while said coil of said first relay or said coil of said second timer relay is energized.

20. The system of claim 19 for use in an overall toilet system on a railroad car, said system further including velocity switch means having a normally open switch that is closed in response to a minimum speed of the car, said velocity switch being connected to said coil of said third time-delay relay and said coil of said second timer relay to prevent their energization except when said velocity switch is closed so that if said velocity switch is open at the completion of the period of time of delay of said third time-delay relay said second timer relay cannot operate to open the valve of said power-operated valved discharge means and then close it after a delay until the speed of the car is at least the minimum speed that causes the closing of the velocity switch and said third time-delay relay is not initiated until such speed is reached.

21. The system of claim 20 wherein said period of time of delay before said normally open contact of said first timer relay opens, after the coil of that relay is energized, is greater than the period of time that after which said first time-delay relay opens its normally closed contact, following the energization of the coil of that relay, to stop the operation of said transfer pump means, so that said second normally open contact of said first relay remains closed to reset said third latch relay after said normally open contact of said temperature-sensing switch means opens, following the turning off of said heater means, so that the normally closed contact is then closed to permit the later operation of said heater means for the next quantity of waste transferred into said sterilization tank.

22. The system of claim 20 and further including macerator/transfer pump means, having a starter relay with a coil, said macerator/transfer pump means being operated while said coil is energized, connected to said inlet of said collection tank to feed said sewage as macerated sewage to said collection tank.

23. The system of claim 22 for its use in an overall toilet system, said system further including:

a toilet system having:

a toilet bowl;

a foot pedal;

switch means operated by depression of said pedal and having first and second normally open contacts that are closed while said pedal is depressed;

flush valve means having a solenoid that, when energized, initiates a feeding of a limited quantity of flush water by said flush valve means, said solenoid being connected to said pedal-operated switch means to be energized when said foot pedal is depressed;

a third relay having a coil and first and second normally open contacts;

a fourth time-delay relay having a coil and first and second normally open contacts; and a fifth time-delay relay having a coil and a normally closed contact, in which:

said first latch relay also has a normally closed contact;

said first normally open contact of said fourth time-delay relay being in parallel with said first normally open contact of said pedal-operated switch means and both connected in series with said solenoid of said flush valve means;

said third relay has its coil connected to said second normally open contact of said pedal-operated switch means and to said normally closed contact of said fifth time-delay relay and said normally closed contact of said first latch relay, to provide an energization of said coil of said starter relay of said macerator/transfer pump means when said second normally open contact of said pedal-operated switch means is closed;

said first normally open contact of said third relay is connected to said coil of that relay, is in parallel with said second normally open contact of said pedal-operated switch means, and is in series with said coil of said starter relay of said macerator/-transfer pump means, said first normally open contact of said third relay providing a holding circuit for both of those coils to continue the operation of said macerator/transfer pump means;

said second normally open contact of said third relay being in series with said coil of said fourth time-delay relay, with said normally closed contact of said fifth time-delay relay and with said normally closed contact of said first latch relay, so that when that coil is energized by the closing of that contact it closes, after a predetermined period of time, said first and second normally open contacts of that relay to energize said solenoid of said flush valve means, to provide a second quantity of flush water to said toilet bowl, and to energize said coil of said fifth time-delay relay, respectively;

said fifth time-delay relay after energization of its coil and said predetermined period of time opens said normally closed contact of that time-delay relay to stop the operation of said macerator/transfer pump means;

said normally closed contact of said first latch relay is opened, when said first latch relay is set, to prevent the operation of said macerator/transfer pump means until that contact is closed by a reset of said first latch relay that occurs at the time when said transfer pump means is turned off.

24. The system of claim 23 wherein:

said period of time of delay before said normally open contact of said first timer relay opens, after the coil of that relay is energized, is greater than the period of time that after which said first time-delay relay opens its normally closed contact, following the energization of the coil of that relay, to stop the operation of said transfer pump means, so that said second normally open contact of said first relay remains closed to reset said third latch relay after said normally open contact of said temperature-sensing switch means opens, following the turning off of said heater means, so that the normally closed contact is then closed to permit the later operation of said heater means for the next quantity of waste transferred into said sterilization tank; and said collection tank and said sterilization tank have about the same volumetric capacity.

* * * * *

UNITED STATES PATENT AND TRADEMARK OFFICE

CERTIFICATE OF CORRECTION

PATENT NO. : 4,012,322

DATED : March 15, 1977

INVENTOR(S) : Philip A. Saigh, et al.

It is certified that error appears in the above-identified patent and that said Letters Patent are hereby corrected as shown below:

Column 1, line 19, "flushed water" should read --flushed waste--.
Column 2, line 21, "human" should read --flushed human--.
Column 5, line 35, "power-generated" should read --power-operated--.
Line 64, "output" should read --outlet--.
Column 6, line 3, "be" should read --do--.
Column 7, line 19, "output" should read --outlet--.
Line 53, "on" should read --one--.
Column 10, line 10, "cloes" should read --closes--.
Column 11, lines 1 and 2, "switch" should read --contact--.
Line 4, "4Cr" should read --4CR--.
Lines 5 and 9, "4Cr-2" should read --4CR-2--.
Line 10, "4Cr" should read --4CR--.
Line 15, "3Lr-1A" should read --3LR-1A--.
Line 15, "3Cr" should read --3CR--.
Line 56, "3CR-1" should read --3CR-3--.
Column 12, line 24, "coil" should read --counter--.
Column 14, line 68, "a deenergized" should read --deenergizes--.
Column 15, line 9, "in" should read --of--.
Line 30, "whe" should read --when--.
Line 42, "3CR-1B" should read --contact 3CR-1B--.
Column 16, line 4, cancel "closes contact 4TD".
Line 18, "the period" should read --this period--.
Line 41, "1Ts-1" should read --1TS-1--.
Column 18, line 65, cancel "the transfer pump means, of".

UNITED STATES PATENT OFFICE

CERTIFICATE OF CORRECTION

Patent No. 4,012,322 Dated March 15, 1977

Inventor(s) Philip A. Saigh et al

It is certified that error appears in the above-identified patent and that said Letters Patent are hereby corrected as shown below:

Column 19, line 37, "heating" should read -- heater --.

Signed and Sealed this

*twelfth* Day of *July 1977*

[SEAL]

*Attest:*

RUTH C. MASON
*Attesting Officer*

C. MARSHALL DANN
*Commissioner of Patents and Trademarks*